US011417278B2

(12) United States Patent
Ahn et al.

(10) Patent No.: US 11,417,278 B2
(45) Date of Patent: Aug. 16, 2022

(54) DISPLAY DEVICE AND DRIVING METHOD THEREOF

(71) Applicant: LG Display Co., Ltd., Seoul (KR)

(72) Inventors: Dongseok Ahn, Gyeongsangnam-do (KR); Suhyeon Jo, Goyang-si (KR); Sungyoung Son, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/129,108

(22) Filed: Dec. 21, 2020

(65) Prior Publication Data

US 2021/0201800 A1 Jul. 1, 2021

(30) Foreign Application Priority Data

Dec. 31, 2019 (KR) ..... 10-2019-0179405

(51) Int. Cl.
*G09G 3/3258* (2016.01)
*G09G 3/3291* (2016.01)
(Continued)

(52) U.S. Cl.
CPC ..... *G09G 3/3258* (2013.01); *G09G 3/2003* (2013.01); *G09G 3/2074* (2013.01);
(Continued)

(58) Field of Classification Search
CPC ..... G09G 2330/021; G09G 3/3266; G09G 3/3258; G09G 3/2022; G09G 3/3685; G09G 3/3677; G09G 2320/0252; G09G 2320/0233; G09G 2320/0646; G09G 2300/0452; G09G 2300/0443; G09G 2340/16; G09G 2300/43; G09G 2320/0242; G09G 2320/045; G09G 2320/0295; G09G 2320/0257; G09G 2320/0214; G09G 2320/0276; G09G 2320/0271;
(Continued)

(56) References Cited

U.S. PATENT DOCUMENTS 6,603,454 B1 * 8/2003 Nakamura ..... G09G 3/3633 345/100
9,262,987 B2 * 2/2016 Albrecht ..... G09G 5/006
(Continued)

FOREIGN PATENT DOCUMENTS

KR 10-2009-0076582 A 7/2009
KR 10-2014-0051745 A 5/2014
KR 10-2019-0034729 A 4/2019

OTHER PUBLICATIONS

Non-Final Office Action, dated Dec. 24, 2021, Son et al., "Display Device for Low-Speed Driving and Driving Method Thereof." 17 pages.

*Primary Examiner* — Dismery Mercedes
(74) *Attorney, Agent, or Firm* — Seed IP Law Group LLP

(57) ABSTRACT

Disclosed are a display device and a driving method thereof. A reference compensation voltage for compensating for a node voltage of each pixel for an image holding period after a refresh period for which image data is input in a low-speed driving mode is set. Then, the node voltage of each sub-pixel is compensated for using a corresponding reference compensation voltage on at least one frame basis at each start time and each end time of the image holding period, thereby preventing low image quality and reducing power consumption.

20 Claims, 7 Drawing Sheets

(51) Int. Cl.
*G09G 3/20* (2006.01)
*G09G 3/36* (2006.01)

(52) U.S. Cl.
CPC ..... *G09G 3/3291* (2013.01); *G09G 3/3607* (2013.01); *G09G 3/3696* (2013.01); *G09G 2300/0443* (2013.01); *G09G 2310/08* (2013.01); *G09G 2320/0209* (2013.01); *G09G 2320/0214* (2013.01); *G09G 2320/0242* (2013.01); *G09G 2320/0257* (2013.01); *G09G 2320/045* (2013.01); *G09G 2320/0626* (2013.01); *G09G 2330/021* (2013.01); *G09G 2360/145* (2013.01)

(58) Field of Classification Search
CPC ... G09G 2320/0693; G09G 2320/0626; G09G 2320/0285; G09G 3/2003; G09G 3/3674; G09G 3/3607; G09G 3/3291; G09G 3/3648; G09G 3/3696; G09G 2310/08; G09G 2330/08; G09G 2330/06; G09G 2340/0435
See application file for complete search history.

(56) References Cited

U.S. PATENT DOCUMENTS

| | | | | |
|---|---|---|---|---|
| 10,068,530 | B2 * | 9/2018 | Lee | G11C 19/186 |
| 10,573,242 | B2 * | 2/2020 | Song | G09G 3/3291 |
| 10,937,370 | B2 * | 3/2021 | Son | G09G 3/3275 |
| 11,094,266 | B2 * | 8/2021 | Heo | G09G 3/3233 |
| 11,094,279 | B2 * | 8/2021 | Chu | G09G 3/3688 |
| 2004/0207615 | A1 | 10/2004 | Yumoto | |
| 2005/0001812 | A1 * | 1/2005 | Amundson | G09G 3/2011 345/107 |
| 2009/0174731 | A1 | 7/2009 | Kim et al. | |
| 2010/0328285 | A1 * | 12/2010 | Jarupoonphol | G09G 3/3655 345/209 |
| 2015/0091950 | A1 * | 4/2015 | Park | G09G 3/3208 345/83 |
| 2016/0027363 | A1 * | 1/2016 | Lee | G09G 3/2003 345/691 |
| 2016/0035320 | A1 | 2/2016 | Yoon et al. | |
| 2016/0217739 | A1 * | 7/2016 | Kang | G09G 3/3233 |
| 2018/0061915 | A1 | 3/2018 | Yu | |
| 2018/0268780 | A1 * | 9/2018 | Bae | G09G 5/026 |
| 2019/0027085 | A1 * | 1/2019 | Zeng | G09G 3/20 |
| 2019/0057978 | A1 * | 2/2019 | Kim | G09G 3/3291 |
| 2021/0110771 | A1 * | 4/2021 | Lee | G09G 3/3258 |
| 2021/0118378 | A1 | 4/2021 | Son et al. | |

* cited by examiner

DISPLAY DEVICE AND DRIVING METHOD THEREOF

CROSS-REFERENCE TO RELATED APPLICATIONS

This application claims the priority of Korean Patent Application No. 10-2019-0179405, filed Dec. 31, 2019, in the Korean Intellectual Property Office, the disclosure of which is hereby incorporated by reference in its entirety.

BACKGROUND

Technical Field

The present disclosure relates to a display device and a driving method thereof, particularly to an display device having a low-speed driving function and a driving method thereof, in which a node voltage of each pixel is compensated during each period for which a displayed image is held in a low-speed driving mode.

Description of the Related Art

An organic light emitting diode based display device is used in various devices such as portable information devices, office equipment, computers, and televisions. The display device includes an image display panel for image display, and gate and data drivers for driving the image display panel, and the like.

There are various approaches for reducing power consumption of the display device. One thereof is a low-speed driving approach.

The low-speed driving scheme includes holding an image of an input frame for a number of frame periods, or refreshing an entire screen of the image display panel at a lower frame frequency than a driving frequency. The low-speed driving scheme may be applied specifically when variation of an input image is small.

However, in a low-speed driving mode, a period for which an image of the input frame is held for a plurality of frame periods is extended, so that an image refresh period for which image data is written and is displayed as an image is also lengthened. In this way, when the image refresh period is long, an image data voltage may not be maintained at a target level for the period for which the image is maintained, thereby causing current leakage and image deterioration.

For example, one frame in a 1 Hz low-speed driving mode is 1 second, which is longer than that in a 120 Hz and 180 Hz high-speed driving mode. Accordingly, current leakage occurs or a target voltage level is lowered for a duration for which luminance implemented in each image display pixel has reached a target level or for a duration for which the luminance must be maintained. Thus, display luminance may vary.

BRIEF SUMMARY

When applying the low-speed driving approach based on the prior art, a node voltage of each of pixels may change for the image holding period. Thus, image quality deterioration such as flicker occurs.

In particular, when the node voltage of each pixel changes or current leak occurs, an image display quality may further deteriorate. For example, brightness and luminance characteristics of the displayed image shifts. In this case, the low-speed driving scheme to reduce power consumption may be useless.

The present disclosure is intended to solve, among others, the problems set forth above in the related art. Thus, one or more embodiments of the present disclosure prevents image deterioration and reduces power consumption.

Some embodiments of the present disclosure provide a display device having a low speed driving function and a driving method thereof, in which a reference compensation voltage for compensating for a node voltage of each pixel for an image holding period after a refresh period for which image data is input in the low-speed driving mode is set, and, further, the node voltage of each sub-pixel is compensated for using a corresponding reference compensation voltage on at least one frame basis at each start time and each end time of the image holding period, thereby preventing low image quality and reducing power consumption.

The technical benefits of the present disclosure are not limited to the above-mentioned benefits. Other benefits and advantages of the present disclosure, as not mentioned above, may be understood from the following descriptions and more clearly understood from the embodiments of the present disclosure. Further, it will be readily appreciated that the benefits and advantages of the present disclosure may be realized by features and combinations thereof as disclosed in the claims.

An optical compensation inspection circuit according to an embodiment of the present disclosure measures brightness and luminance characteristic variations of an image displayed on an image display panel in the low-speed driving mode in an inspection step of an image display panel on preset multiple of frames basis. Then, based on the brightness and luminance characteristic variations of the image, the optical compensation inspection circuit sets a magnitude and a supply duration of each of reference compensation voltages to compensate for a node voltage of each pixel for an image holding period after a refresh period in which image data is input in the low-speed driving mode.

A timing controller for controlling a driving timing of the image display panel aligns image data based on driving frequency characteristic of the image display panel and supplies the aligned data to a data driver and further controls an output timing of a gate drive signal of a gate driver.

Under the control of the timing controller, the data driver sequentially supplies the image data voltage corresponding to the image data to each sub-pixel for the refresh period set based on the driving frequency of the image display panel. For the image holding period, the data driver supplies different first and second preset reference compensation voltages to each of the sub-pixels respectively at a start time and an end time of an image holding period based on the driving frequency of the image display panel, such that the image data voltage is maintained to be constant.

In this connection, the data driver may drive each data line to supply the first preset reference compensation voltage to each sub-pixel on at least one frame basis at the start time of the image holding period such that the image data voltage is maintained to be constant at the start time of the image holding period, wherein the first preset reference compensation voltage is associated with the start time of the image holding period. The data driver may drive each data line to supply the second preset reference compensation voltage to each sub-pixel on at least one frame basis at the end time of the image holding period such that the image data voltage is maintained to be constant at the end time of the image holding period, wherein the second preset reference compensation voltage is associated with the end time of the image holding period.

In the display device and the driving method according to an embodiment of the present disclosure as described above, the reference compensation voltages for compensating for the node voltage of each sub-pixel P for the image holding period after the refresh period for which the image data is input in the low-speed driving mode may be set.

In addition, a node voltage of each of all sub-pixels is compensated for based on the reference compensation voltages on at least one frame basis at each start time and each end time of each image holding period.

Accordingly, the display device having the low-speed driving function and the driving method thereof according to the present disclosure may achieve an effect of preventing deterioration of image quality and reducing power consumption for the image holding period.

Further specific effects of the present disclosure as well as the effects as described above will be described in conduction with illustrations of specific details for carrying out the present disclosure.

DETAILED DESCRIPTIONS

Figure 1:
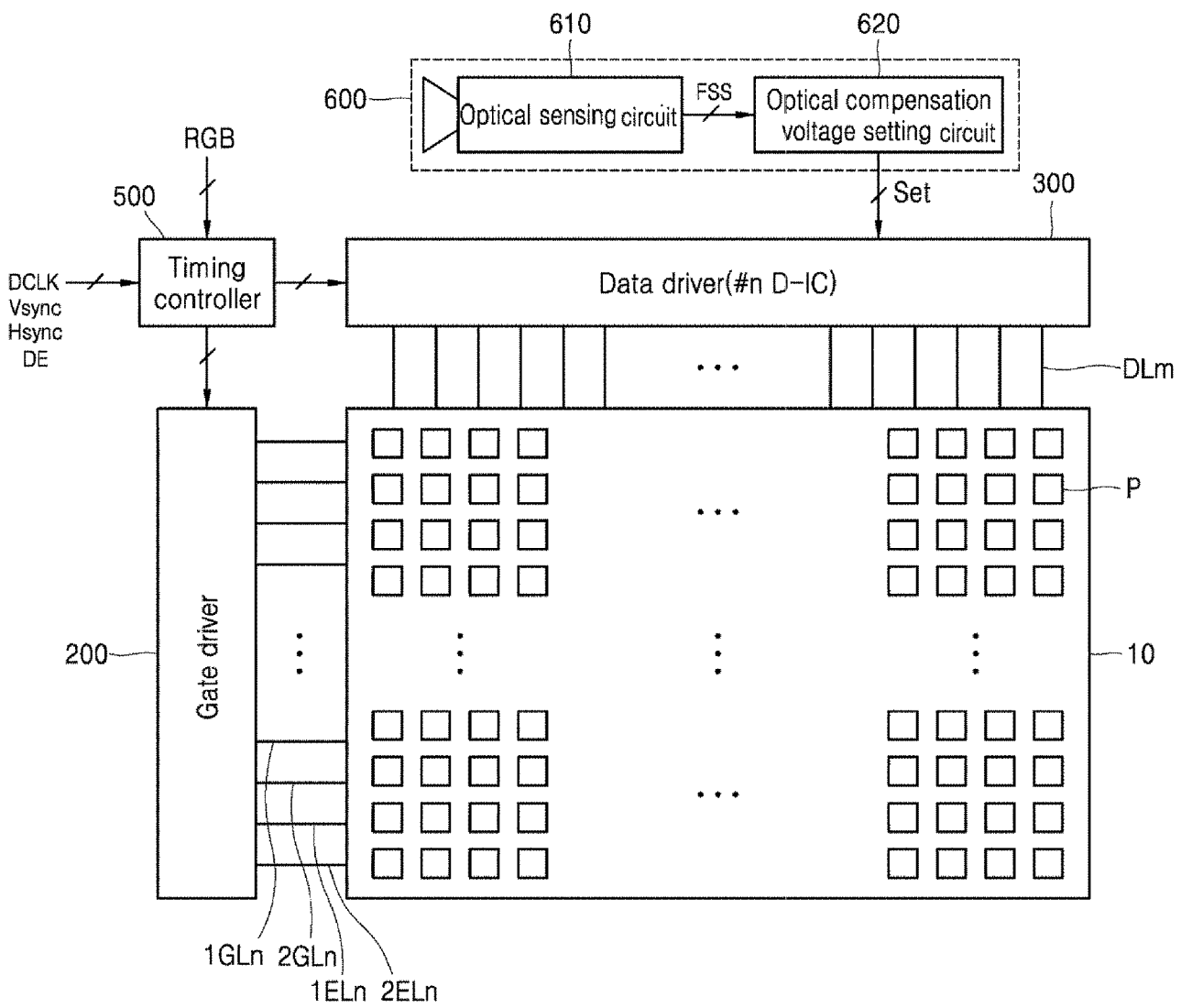
FIG. 1 is a block diagram showing a display device having a low-speed driving function according to an embodiment of the present disclosure.

For simplicity and clarity of illustration, elements in the figures are not necessarily drawn to scale. The same reference numbers in different figures represent the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure.

The terminology used herein is for the purpose of describing particular embodiments only and is not intended to limit the present disclosure. As used herein, the singular forms "a" and "an" are intended to include the plural forms as well, unless the context clearly indicates otherwise. It will be further understood that the terms "comprises," "comprising," "includes," and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first," "second," "third," and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers.

It will be understood that when an element or layer is referred to as being "connected to," or "coupled to" another element or layer, it may be directly connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may also be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, a display device having a low-speed driving function and a driving method thereof according to an embodiment of the present disclosure will be described in detail with reference to the accompanying drawings. In this connection, the display device will be embodied as an organic light-emitting diode display device including an organic light-emitting diode display panel by way of example.

FIG. 1 is a block diagram showing a display device having a low-speed driving function according to an embodiment of the present disclosure.

The display device shown in FIG. 1 includes an image display panel 10, a gate driver 200, a data driver 300, a timing controller 500, and a power supply (not shown).

The image display panel 10 displays an image using sub-pixels P provided in each pixel region. In the image display panel 10, a plurality of R, G, and B sub-pixels P or R, G, B, and W sub-pixels P are arranged in a matrix form in each pixel region to display an image. Each sub-pixel P is composed of an organic light-emitting diode and a pixel circuit for driving the light-emitting diode independently.

The pixel circuit of each sub-pixel P is configured so that a driving voltage corresponding to an image data voltage, for example, an analog image voltage, from a data line DLm connected thereto is supplied to the organic light-emitting diode while charging of the image data voltage is maintained so that a light-emitting state is maintained. In this connection, n and m are natural numbers other than 0 and may be the same as or different from each other.

A detailed structure of each sub-pixel P, that is, a detailed structure of the organic light-emitting diode and the pixel circuit, and operating characteristics thereof will be described in detail with reference to FIG. 2 to FIG. 7.

First, the timing controller 500 shown in FIG. 1 configures image data input through an external device such as a graphic system based on driving characteristics such as a resolution of the image display panel 10 and a driving frequency for a low-speed driving mode and then transmits the configured image data to the data driver 300.

Specifically, the timing controller 500 may control driving timing of the gate and data drivers 200 and 300 such that the image display panel 10 is driven for a refresh period and an image holding period in a distinguished manner, wherein a plurality of frame periods are divided into a refresh period and an image holding period based on a driving frequency of the image display panel 10. Accordingly, the timing controller 500 may allocate image data to each of sub-pixels of every horizontal line so that the image data voltage may be supplied to sub-pixels for a refresh period preset based on the driving frequency for the low-speed driving mode.

For example, the timing controller 500 may allocate image data to each of sub-pixels of each horizontal line so that the image data voltage may be sequentially supplied to each sub-pixel during a refresh period preset based on a 1 Hz driving mode. Then, during the refresh period, the allocated image data may be transmitted to the data driver 300 sequentially. Further, the transmission of the image data is stopped for the image holding period after the refresh period.

In addition, the timing controller 500 uses synchronization signals DCLK, Vsync, Hsync, DE input from an outside (e.g., external data source or external device) to generate first and second gate control signals and first and second data control signals so that the gate and data drivers 200 and 300 are driven based on the driving frequency for the low-speed driving mode.

Specifically, the timing controller 500 generates a first gate control signal and a first data control signal so that each sub-pixel sequentially displays an image during a refresh period. In addition, the timing controller 500 generates a second gate control signal and a second data control signal such that the image displayed by each sub-pixel P is held on each frame basis for the image holding period. In this way, the timing controller 500 supplies the first and second gate control signals and the first and second data control signals to the gate and data drivers 200 and 300 respectively, for the refresh and image holding periods in a distinguished manner, thereby driving timings of the gate and data drivers 200 and 300.

The gate driver 200 sequentially generates a plurality of first and second scan pulses for the refresh period in response to reception of the first gate control signal, for example, a first gate start pulse and a first gate shift clock, etc., as input from the timing controller 500. The gate driver 200 controls pulse widths of the first and second scan pulses based on a gate output enable signal. Then, the gate driver 200 sequentially supplies each of the first and second scan pulses to each of first and second gate lines 1GLn and 2GLn.

Further, the gate driver 200 sequentially generates a plurality of first and second light-emitting control signals in response to reception of the first gate start pulse and a plurality of first gate shift clocks, etc. The gate driver 200 sequentially supplies each of the first and second light-emitting control signals to each of first and second light-emitting control lines 1ELn and 2ELn during the refresh period.

Likewise, the gate driver 200 sequentially generates a plurality of first and second scan pulses every frame period for the image holding period in response to reception of a second gate control signal as input from the timing controller 500 for the image display period, for example, a second gate start pulse and a second gate shift clock, etc. The gate driver 200 controls pulse widths of the first and second scan pulses based on a gate output enable signal. Then, the gate driver 200 sequentially supplies each of the first and second scan pulses to each of the first and second gate lines 1GLn and 2GLn. Further, the gate driver 200 sequentially generates a plurality of first and second light-emitting control signals in response to reception of the second gate start pulse and the second gate shift clock, etc. Then, the gate driver 200 sequentially supplies the first and second light-emitting control signals to the first and second light-emitting control lines 1ELn and 2ELn, respectively for the image holding period.

The data driver 300 sequentially supplies an image data voltage corresponding to image data to each sub-pixel P during the refresh period under control of the timing controller 500. For the image holding period in which the displayed image is maintained after the refresh period, the data driver 300 supplies a reference compensation voltage to each sub-pixel P on at least one frame basis to drive each data line DLm so that the image data voltage is compensated for and then maintained.

Specifically, the data driver 300 latches image data aligned by the timing controller 500 on each horizontal line basis, based on a first source start pulse and a first source shift clock among the first data control signal from the timing controller 500. That is, the data driver 300 latches and converts the image data such that the corresponding image data voltage is supplied to each sub-pixel sequentially on each horizontal line basis for each refresh period. Further, the data driver 300 supplies the image data voltage to each data line DLm on each horizontal line basis in response to receiving the source output enable signal.

Next, the data driver 300 supplies the reference compensation voltage to each data line DLm on each horizontal line basis for each frame period for the image holding period in response to receiving the second data control signal. In this connection, a voltage magnitude of the reference compensation voltage may vary based on a compensation voltage magnitude set by a separate optical compensation inspection circuit 600 on at least one frame period basis.

Figure 2:
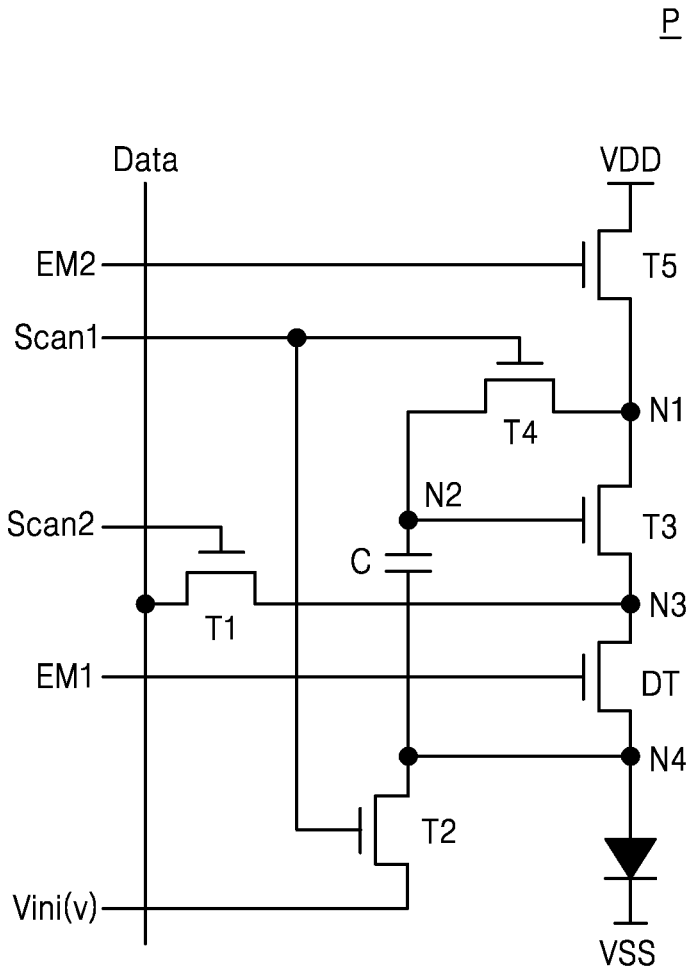
FIG. 2 is a circuit diagram showing one sub-pixel of an image display panel shown in FIG. 1.

FIG. 2 is a circuit diagram showing one sub-pixel of the image display panel shown in FIG. 1.

Referring to FIG. 2, each sub-pixel P receives the first scan signal Scan1 via the first gate line 1GLn, and receives the second scan signal Scan2 via the second gate line 2GLn. Each sub-pixel P receives the first and second light-emitting control signals EM1 and EM2 via the first and second light-emitting control lines 1ELn and 2ELn, respectively, and receives the image data voltage Data and the reference compensation voltage via the data line DLm. Further, each sub-pixel P may be configured to receive a high potential voltage VDD, a low potential voltage VSS and an initialization voltage Vini(v) via power supply lines.

The organic light-emitting diode of each sub-pixel P is composed of an anode, a cathode, and an organic light-emitting layer between the anode and the cathode.

The pixel circuit that controls driving of the organic light-emitting diode may have a source follower type compensation circuit structure. Thus, the pixel circuit may include first to fifth switching elements T1 to T5, a storage capacitor C, a driving switching element DT, and the like. The pixel circuit in accordance with the present disclosure is not limited to the source follower type compensation circuit structure but may apply other internal compensation circuits.

The first switching element T1 of the pixel circuit is switched or turned on based on the second scan signal Scan2 from the second gate line 2GLn, such that the image data voltage Data or reference compensation voltages input from the data line DLm are sequentially transmitted to a third node N3 to which the driving switching element DT is connected.

The second switching element T2 is switched or turned on based on the first scan signal Scan1 from the first gate line 1GLn, such that the initialization voltage Vini(v) input from the data driver 300 or the power supply is supplied to the storage capacitor C, a fourth node N4 to which the driving switching element DT is connected, and the fourth switching element T4.

The third switching element T3 is switched on based on a charge/discharge voltage of the storage capacitor C, such that the initialization voltage Vini(v) or the high potential voltage VDD is supplied to a third node N3 to which the driving switching element DT is connected.

The fourth switching element T4 is switched on based on the first scan signal Scan1 from the first gate line 1GLn, such that the initialization voltage Vini(v) input via the second switching element T2 and the storage capacitor C is supplied to the driving switching element DT and a first node N1 to which the fifth switching element T5 is connected.

The fifth switching element T5 acts as a light-emitting control element, and is switched on based on the second light-emitting control signal EM2 input via the second light-emitting control line 2ELn, such that the high potential voltage VDD input via the power supply (not shown) is supplied to the first node N1 connected to the third switching element T3.

The driving switching element DT has a source connected to the third node N3 connected to the third switching element T3, and a drain connected to the fourth node to which the organic light-emitting diode is connected, and a gate connected to the first light-emitting control line 1ELn. Accordingly, the driving switching element DT allows a threshold voltage Vth to be stored in the storage capacitor C based on the initialization voltage Vini(v), and is turned on based on the first light-emitting control signal EM1 input via the first light-emitting control line 1ELn. Accordingly, upon receiving the image data voltage for a refresh period, the driving switching element DT may supply a driving voltage of the organic light-emitting diode corresponding to a magnitude of the image data voltage for which the threshold voltage Vth is compensated, to the organic light-emitting diode. Thus, the organic light-emitting diode emits light. Further, the driving switching element DT may supply a driving voltage (alternatively, a light-emitting control voltage of the organic light-emitting diode) corresponding to a magnitude of the image data voltage for which the threshold voltage Vth is compensated, to the organic light-emitting diode for the image holding period, such that the organic light-emitting diode maintains the light-emitting state thereof.

Figure 3A:
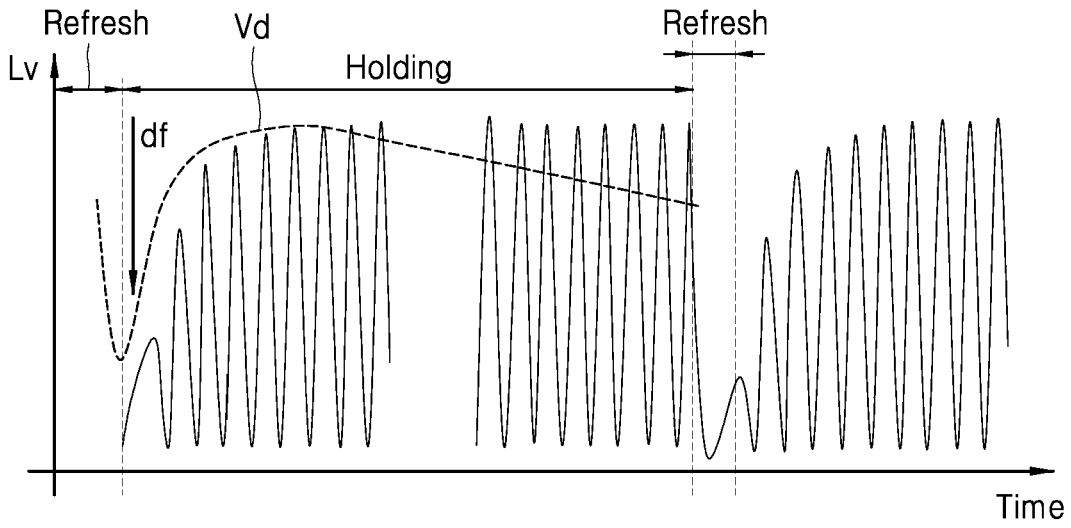
FIGS. 3A and 3B are graphs showing magnitude variation of an image data voltage during an image holding period after an image refresh period.
Figure 3B:
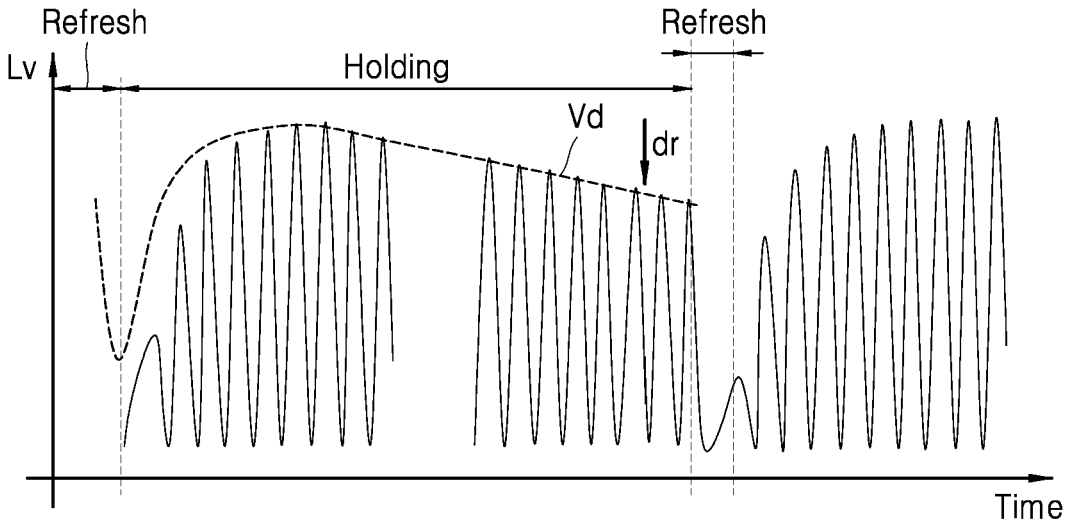

FIGS. 3A and 3B are graphs showing magnitude variation of the image data voltage for the image holding period after the image refresh period.

Brightness and luminance change for the refresh period for which the image data voltage is input to all sub-pixels P over a frame period for which all sub-pixel Ps of the image display panel 10 emit light to display an image. However, for the image holding period for which the image data voltage must be maintained in a held state, all of the sub-pixels P must be kept in the light-emitting state.

However, as shown in FIG. 3A, at a start time of the image holding period, a charging voltage of each sub-pixel may not reach a target voltage magnitude, due to unique operating characteristics (e.g., threshold voltage characteristic, mobility, charging deviation, or the like) of the pixel circuits different between different image display panels. When a driving voltage Vd of the organic light-emitting diode is deviated due to the charging deviation df at the start time duration, display luminance is variable.

Further, as shown in FIG. 3B, at an end time of the image holding period for which the image data voltage is held, all of the sub-pixels P maintain the light-emitting state thereof for a long time such that brightness and luminance of the image may drop or rise due to the unique display panel characteristics. For example, the driving voltage Vd of the organic light-emitting diode is deviated due to the charging deviation dr generated at the end time of the image holding period. Thus, the display luminance may be varied.

Figure 4A:
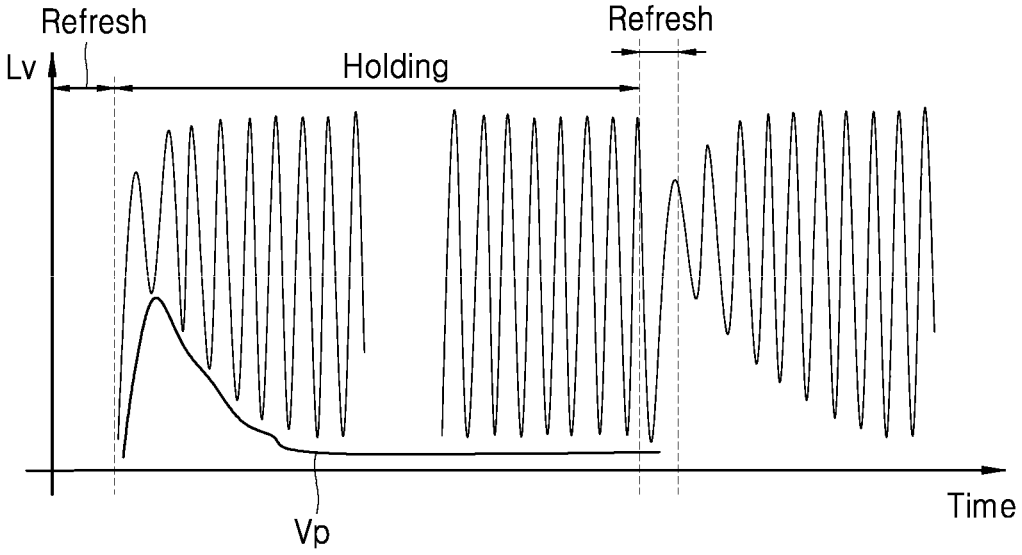
FIGS. 4A and 4B are diagrams for illustrating a reference compensation voltage setting scheme for the image holding period shown in FIGS. 3A and 3B.
Figure 4B:
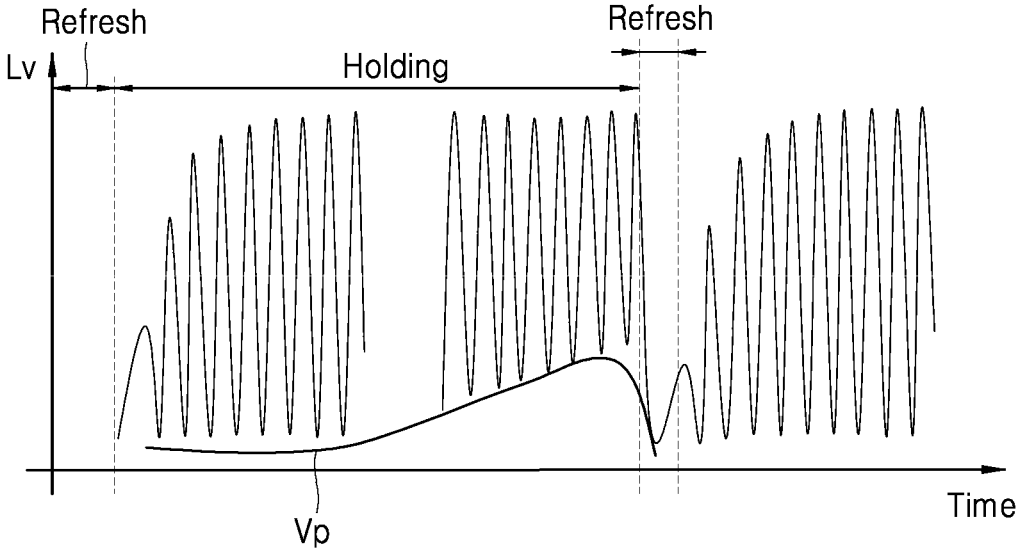
Figure 5:
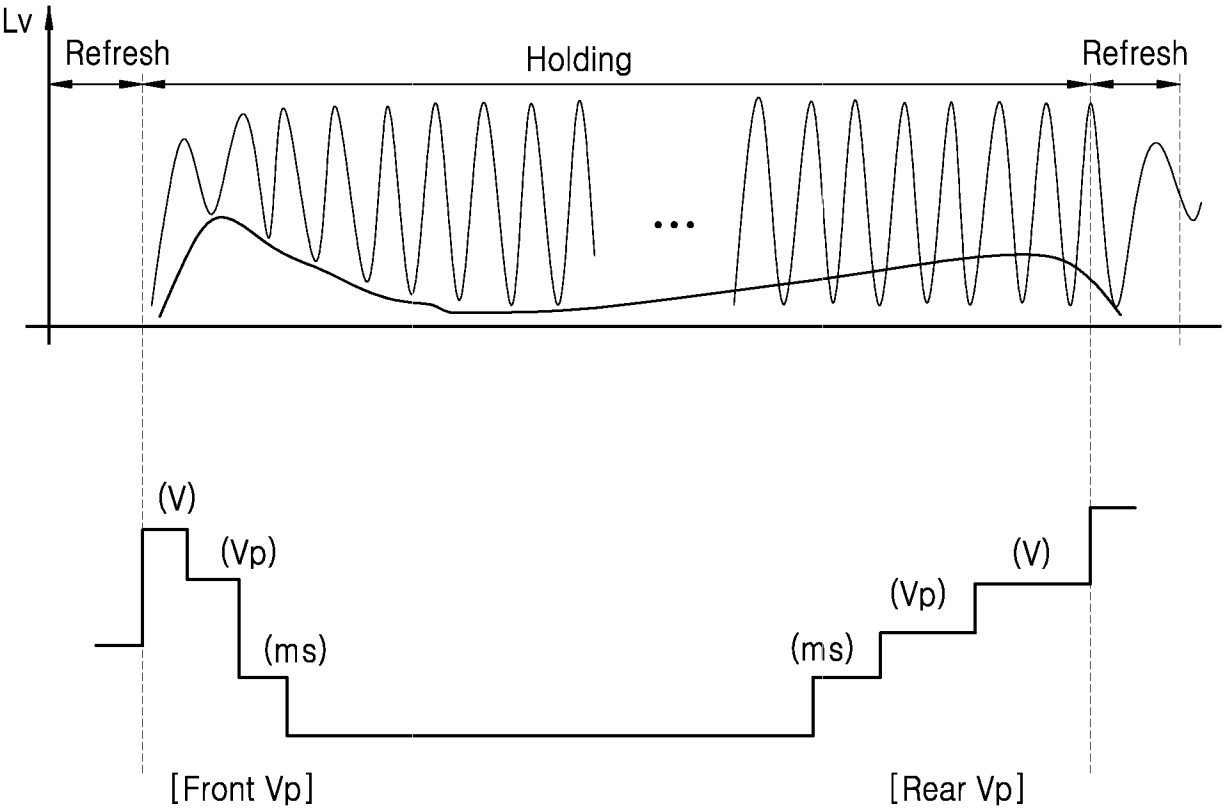
FIG. 5 is a graph for illustrating an output timing of the reference compensation voltage and a corresponding compensation timing for the image holding period shown in FIGS. 3A, 3B, 4A and 4B.

FIGS. 4A and 4B are diagrams for illustrating a method for setting the reference compensation voltage for the image holding period shown in FIGS. 3A and 3B. FIG. 5 is a graph for illustrating an output timing of the reference compensation voltage and a corresponding compensation timing for the image holding period shown in FIGS. 3A, 3B, 4A, and 4B.

First, referring to FIGS. 4A, 4B together with FIG. 1, an optical compensation inspection circuit 600 may detect and set a magnitude of a reference compensation voltage Vp to decrease or increase a node voltage of each sub-pixel P such that the brightness and luminance implemented via all of the sub-pixel Ps are constant without rising or falling for the image holding period.

The reference compensation voltage Vp refers to an analog voltage which is set to be constant or variable on a preset period basis within the image holding period and then is supplied to each sub-pixel P via the data line DLm for the image holding period.

As shown in FIG. 3A, at the start time of the image holding period, the charging deviation df occurs based on the threshold voltage characteristic, mobility, and charging deviation of the pixel circuit. As shown in FIG. 3B, at the end time of the image holding period, the charging deviation dr may occur due to increase of the duration of the light-emitting holding period. Thus, the reference compensation voltage Vp must be set to compensate for the charging deviation df at the start time thereof and the charging deviation dr at the end time thereof.

To this end, referring to FIG. 5 together with FIGS. 4A and 4B, the optical compensation inspection circuit 600 may detect and set magnitudes of reference compensation voltages Front Vp and Rear Vp to decrease or increase a node voltage of each sub-pixel P such that the brightness and luminance implemented via all of the sub-pixel Ps are constant without rising or falling at the start and end times of the image holding period, respectively. In this connection, Front Vp refers to a value set to compensate for the charging deviation df at the start time. Rear Vp refers to a value set to compensate for the charging deviation dr at the end time.

In order to set the magnitudes of the reference compensation voltages Front Vp and Rear Vp to decrease or increase a node voltage of each sub-pixel P such that the brightness and luminance implemented via all of the sub-pixel Ps are constant without rising or falling at the start and end times of the image holding period, respectively, the optical compensation inspection circuit 600 measures the brightness and luminance characteristic variations of the image on a preset period or at least one frame basis in an inspection step of the image display panel 10.

The optical compensation inspection circuit 600 may preset a magnitude and a supply duration of each of the reference compensation voltages Front Vp and Rear Vp for compensating the node voltage of each sub-pixel for the image holding period, based on the brightness and luminance characteristic variations of the image detected at the start time and the end time of the image holding period.

Specifically, an optical sensing circuit 610 of the optical compensation inspection circuit 600 measures and detects the brightness and luminance characteristic variations of the image display panel 10 using at least one photo sensor or the like on at least one frame basis.

A reference compensation voltage setting circuit 620 may set a magnitude and a supply duration Front Vp (V, Vp, ms) and Rear Vp (V, Vp, ms) of each of the reference compensation voltages for compensating the node voltage of each sub-pixel at the start and the end time of the image holding period, based on the measured and detected brightness and luminance characteristic variations of the image display panel 10 on at least one frame basis. Then, the reference compensation voltage setting circuit 620 may send a setting code or information corresponding to the magnitude and the supply duration Front Vp (V, Vp, ms) and Rear Vp (V, Vp, ms) of each of the reference compensation voltages to each data driver IC (#n D-IC) included in the data driver 300 and a separate memory.

In this connection, V of Front Vp refers to a maximum compensation voltage value for compensation for the charging deviation df at the start time. Vp of Front Vp refers to a compensation voltage value for each step during the period for which the charging deviation df at the start time is compensated for. ms of Front Vp refers to duration for which the reference compensation voltage is applied for each step.

Further, V of Rear Vp refers to a maximum compensation voltage value for compensation for the charging deviation df at the end time. Vp of Rear Vp refers to a compensation voltage value for each step during the period for which the charging deviation df at the end time is compensated for. ms of Rear Vp refers to duration for which the reference compensation voltage is applied for each step.

As shown in FIG. 5, the reference compensation voltage setting circuit 620 may set a magnitude and a supply duration Front Vp (V, Vp, ms) and Rear Vp (V, Vp, ms) of each of the reference compensation voltages for compensating the node voltage of each sub-pixel at the start and the end time of the image holding period, based on the measured and detected brightness and luminance characteristic variations of the image display panel 10 on at least one frame basis. Then, the reference compensation voltage setting circuit 620 may send a setting code or information corresponding to the magnitude and the supply duration Front Vp (V, Vp, ms) and Rear Vp (V, Vp, ms) of each of the reference compensation voltages to each data driver IC (#n D-IC) included in the data driver 300 and a separate memory.

Specifically, the reference compensation voltage setting circuit 620 may set Front Vp (V, Vp, ms) and Rear Vp (V, Vp, ms) of the reference compensation voltages related to a first frame based on the brightness and luminance characteristic variations related to at least one frame in the image holding period, that is, the brightness and luminance characteristic variations related to the first frame within the image holding period relative to the brightness and luminance characteristics of the refresh period.

Further, the reference compensation voltage setting circuit 620 may set Front Vp (V, Vp, ms) and Rear Vp (V, Vp, ms) of the reference compensation voltages related to a second frame based on the brightness and luminance characteristic variations related to the second frame within the image holding period relative to the brightness and luminance characteristics of the refresh period.

Then, the reference compensation voltage setting circuit 620 may set Front Vp (V, Vp, ms) and Rear Vp (V, Vp, ms) of the reference compensation voltages related to a third frame based on the brightness and luminance characteristic variations related to the third frame within the image holding period relative to the brightness and luminance characteristics of the refresh period.

In this connection, the number of the frames for which Front Vp (V, Vp, ms), and Rear Vp (V, Vp, ms) are set may vary based on the driving frequency of the image display panel 10, for example, 60 Hz, 120 Hz, 180 Hz, 240 Hz, etc.

In this way, the reference compensation voltage setting circuit 620 may set Front Vp (V, Vp, ms), and Rear Vp (V, Vp, ms) for the number of the frames to which the reference compensation voltages are applied based on the driving frequency of the image display panel 10, for example, 60 Hz, 120 Hz, 180 Hz, 240 Hz, etc. Then, the reference compensation voltage setting circuit 620 may store the setting code or information indicating the set Front Vp (V, Vp, ms), and Rear Vp (V, Vp, ms) into the data driver 300 and the like.

Figure 6:
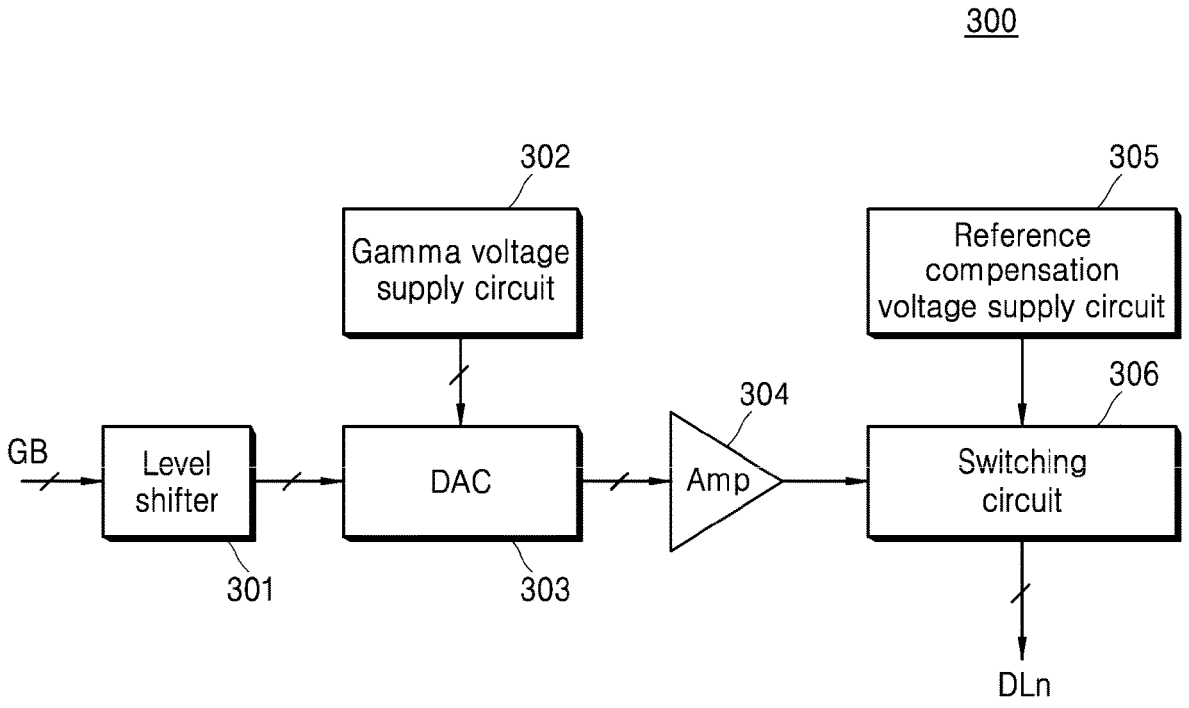
FIG. 6 is a block diagram specifically showing a data driver shown in FIG. 1.

FIG. 6 is a block diagram showing the data driver shown in FIG. 1 in detail.

Referring to FIG. 6, each data driver IC (#n D-IC) included in the data driver 300 may latch and convert the image data and may supply the same to each data line DLm such that the image data voltage is sequentially supplied to each sub-pixel on each horizontal line basis for the refresh period for which the image is written.

That is, for the refresh period, a level shifter 301 of each data driver IC #n D-IC latches digital image data RGB sequentially input from the timing controller 500 every horizontal line and then supplies the data to a digital-to-analog converter (DAC) 303. Accordingly, the digital-analog converter 303 converts the digital image data RGB to an analog data voltage using a reference gamma voltage from a gamma voltage supply circuit 302. A buffer output circuit 304 amplifies the analog data voltage and supplies the same to a switching circuit 306. Then, the switching circuit 306 transmits the analog data voltage to a corresponding data line DLm based on a first output control signal input from the timing controller 500 during the refresh period.

For the image holding period after the refresh period in which the image is displayed, a reference compensation voltage supply circuit 305 sequentially generates the reference compensation voltages Vp based on Front Vp (V, Vp, ms) and Rear Vp (V, Vp, ms) and then supplies the voltages Vp to the switching circuit 306.

Accordingly, for the image holding period, the switching circuit 306 transmits, to the corresponding data line DLm, the reference compensation voltages Vp sequentially input from the reference compensation voltage supply circuit 305 based on a second output control signal input from the timing controller 500.

In one example, when the driving frequency of the image display panel 10 is 60 Hz (Anode Reset (60 Hz)), a first frame period is a refresh period. The image data voltage is sequentially written to each sub-pixel P for the first frame period to display a frame image. Subsequently, second to 60-th frame periods constitute the image holding period. In this way, for a preset start time duration from a second frame of the image holding period, the preset reference compensation voltage Vp related to the start time is sequentially written to each sub-pixel P so that the image data voltage is maintained.

In addition, for a preset predetermined end time duration of the image holding period, the preset reference compensation voltage Vp related to the end time is written to each sub-pixel P so that the image data voltage is maintained.

Thus, the node voltage of each sub-pixel P may be compensated for based on the preset reference compensation voltage Vp for the image holding period, such that the driving voltage of the organic light-emitting diode may be maintained. This may prevent the rise of the node voltage of the sub-pixel P and the driving voltage of the organic light-emitting diode to maintain the brightness and luminance at the target level.

Next, an image display operation sequence of each sub-pixel P for the refresh period in which the image is written and the image holding period is sequentially described as follows.

Figure 7:
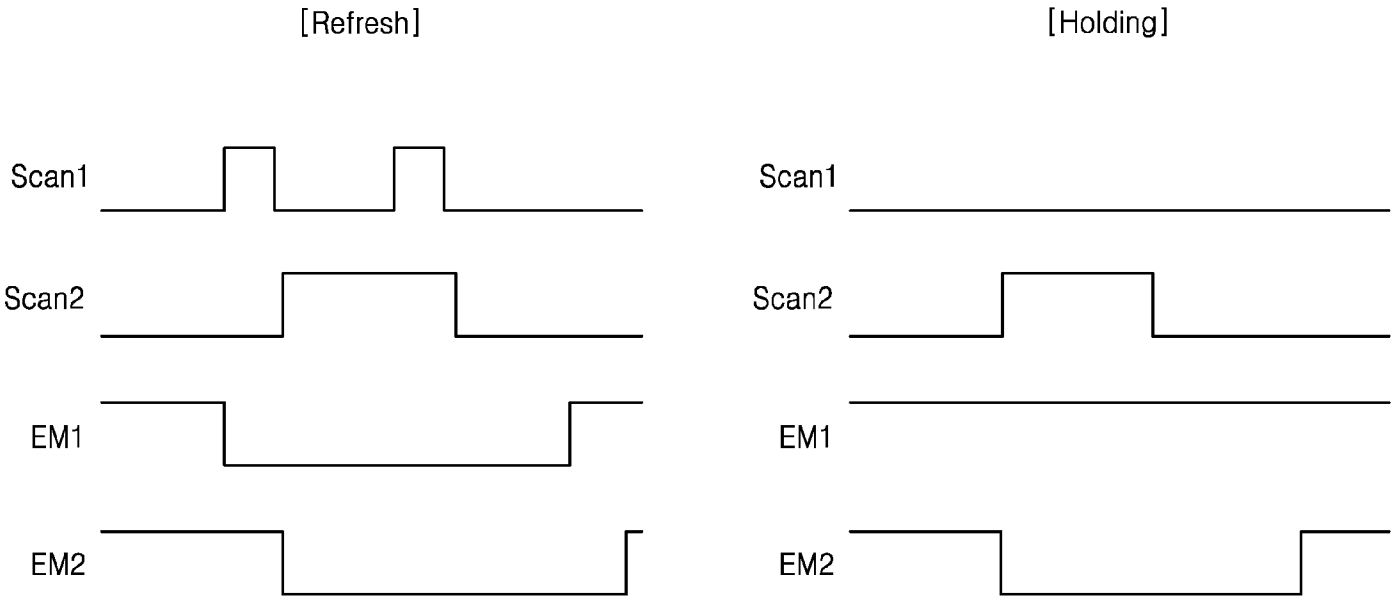
FIG. 7 is a timing diagram showing gate driving signals input to sub-pixels in the image holding period.

FIG. 7 is a timing diagram showing gate driving signals input to sub-pixels for the image holding period.

Referring to FIG. 7, for an initialization period of the refresh period, the second switching element T2 of each sub-pixel P supplies the initialization voltage Vini(v) input from the data driver 300 or the power supply circuit to the storage capacitor C, the fourth node N4 connected to the driving switching element DT, and the fourth switching element T4 in response to receiving the first scan signal Scan1 from the first gate line 1GLn.

In this connection, the fifth switching element T5 supplies a high potential voltage VDD input from the power supply, etc., to the first node N1 connected to the third switching element T3 in response to the reception of the second light-emitting control signal EM2 input via the second light-emitting control line 2ELn.

Subsequently, for the compensation period of the refresh period, the first switching element T1 of each sub-pixel P is switched on based on the second scan signal Scan2 from the second gate line 2GLn, such that the image data voltage Data input from the data line DLm is sequentially transmitted to the third node N3 to which the driving switching element DT is connected. Thus, the threshold voltage Vth based on the image data voltage Data and the initialization voltage Vini(v) is stored in the storage capacitor C.

In this connection, the fourth switching element T4 supplies the threshold voltage Vth input via the second switching element T2 and the storage capacitor C to the driving switching element DT and the first node N1 to which the fifth switching element T5 as the light-emitting control element is connected, in response to the reception of the first scan signal Scan1 from the first gate line 1GLn. Accordingly, the third switching element T3 is switched on based on a discharge voltage of the storage capacitor C, so that the image data voltage compensated for based on the threshold voltage Vth is supplied to the third node N3 to which the driving switching element DT is connected.

Subsequently, for the image display period of the refresh period, the driving switching element DT of each sub-pixel P is turned on based on the reception of the first light-emitting control signal EM1 input via the first light-emitting control line 1ELn, such that the driving voltage of the organic light-emitting diode corresponding to a magnitude of the image data voltage for which the threshold voltage Vth having been compensated is supplied to the organic light-emitting diode. Thus, the organic light-emitting diode emits light.

Next, since a first frame period of the image holding period, the second switching element T2 and the fourth switching element T4 maintain a turned-off state. That is, the first scan signal Scan1 is kept at an inactive state.

However, the fifth switching element T5 supplies a high-potential voltage VDD input via a power supply or the like to the first node N1 connected to the third switching element T3 in response to reception of the second light-emitting control signal EM2 input via the second light-emitting control line 2ELn.

Subsequently, the first switching element T1 is switched on based on the second scan signal Scan2 from the second gate line 2GLn, such that the reference compensation voltage Vp input from the corresponding data line DLm is sequentially transmitted to the third node N3 to which the driving switching element DT is connected.

The reference compensation voltage Vp is set to increase or decrease the voltage of the third node N3 and the threshold voltage of the storage capacitor C. When the reference compensation voltage Vp is input, the voltage of the third node N3 is changed. Accordingly, the threshold voltage of the storage capacitor C may be adjusted to be high or low based on the reference compensation voltage Vp. Therefore, the third switching element T3 allows the threshold voltage Vth of the driving switching element DT to be compensated for based on the discharge voltage of the storage capacitor C. Thus, the driving voltage of the organic light-emitting diode may be stably maintained.

The driving switching element DT of each sub-pixel P is maintained to be in a turned-on state for the image holding period. Thus, the driving voltage of the organic light-emitting diode adjusted to the threshold voltage Vth that is increased or decreased based on the reference compensation voltage Vp may be maintained. Thus, the driving voltage of the organic light-emitting diode adjusted to the threshold voltage Vth based on the reference compensation voltage Vp may be fed to the organic light-emitting diode, such that the organic light-emitting diode maintains brightness and luminance at the constant target level.

As described above, in the display device and the driving method according to an embodiment of the present disclosure as described above, Front Vp (V, Vp, ms) and Rear Vp (V, Vp, ms) of the reference compensation voltage for compensating for the node voltage of each sub-pixel P for the image holding period after the refresh period for which the image data RGB is input in the low-speed driving mode may be set. In addition, the node voltage of the sub-pixel may be compensated for on at least one frame basis for each image holding period between the refresh periods.

Accordingly, the display device having the low-speed driving function and the driving method thereof according to the present disclosure may achieve an effect of preventing deterioration of image quality and reducing power consumption for the image holding period.

As described above, the present disclosure is described with reference to the drawings. However, the present disclosure is not limited by the embodiments and drawings disclosed in the present specification. It will be apparent that various modifications may be made thereto by those skilled in the art within the scope of the present disclosure. Furthermore, although the effect resulting from the features of the present disclosure has not been explicitly described in the description of the embodiments of the present disclosure, it is obvious that a predictable effect resulting from the features of the present disclosure should be recognized.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A device, comprising:

an image display panel having a plurality of sub-pixels to display an image;

a data driver; and a timing controller configured to:

align image data from an external data source based on a driving frequency characteristic of the image display panel;

supply the aligned image data to the data driver; and control an output timing of a gate drive signal of a gate driver;

wherein the data driver is configured to:

sequentially supply an image data voltage corresponding to the image data to each of the sub-pixels for a refresh period set based on the driving frequency of the image display panel;

supply different first and second preset reference compensation voltages to each of the sub-pixels respectively at a start time and an end time of an image holding period based on the driving frequency of the image display panel; and drive each data line to supply the first preset reference compensation voltage to each sub-pixel on at least one frame basis at the start time of the image holding period such that the image data voltage is maintained to be either constant or substantially constant at the start time of the image holding period, wherein the first preset reference compensation voltage is associated with the start time of the image holding period.

2. The device of claim 1, wherein the timing controller is further configured to:

control a driving timing of each of the gate and data drivers so that the image display panel is driven in a divided manner into the refresh period and the image holding period, wherein a plurality of frame periods are divided into the refresh period and the image holding period based on the driving frequency of the image display panel;

generate a first gate control signal and a first data control signal so that each of the sub-pixels sequentially displays an image for the refresh period;

generate a second gate control signal and a second data control signal such that the image displayed on each of the sub-pixels is held on a frame basis for the image holding period;

supply the first gate control signal and the first data control signal to the gate driver and the data driver respectively for the refresh period; and supply the second gate control signal and the second data control signal to the gate driver and the data driver respectively for the image holding period.

3. The device of claim 1, wherein the device further comprises the gate driver, wherein the gate driver is configured to:

in response to receiving a first gate control signal input from the timing controller for the refresh period, sequentially generate a plurality of first and second scan pulses and a plurality of first and second light-emitting control signals; and supply the plurality of first and second scan pulses and the plurality of first and second light-emitting control signals to each of the sub-pixels; and in response to receiving a second gate control signal input from the timing controller for the image holding period, sequentially generate the plurality of first and second scan pulses and the plurality of first and second light-emitting control signals; and supply the plurality of first and second scan pulses and the plurality of first and second light-emitting control signals to each of the sub-pixels either at the same timing as a timing of the refresh period or different timing from a timing of the refresh period.

4. The device of claim 1, wherein the data driver is further configured to:

drive each data line to supply the second preset reference compensation voltage to each sub-pixel on at least one frame basis at the end time of the image holding period such that the image data voltage is maintained to be either constant or substantially constant at the end time of the image holding period, wherein the second preset reference compensation voltage is associated with the end time of the image holding period.

5. The device of claim 4, wherein the data driver is further configured to:

generate the different first and second reference compensation voltages on at least one frame basis, based on values of reference compensation voltages set by an optical compensation inspection circuit respectively at the start time and the end time;

supply the generated first and second reference compensation voltages to each of the sub-pixels respectively at the start time and the end time of the image holding period on at least one frame basis; and vary the values of the reference compensation voltages on at least one frame basis.

6. The device of claim 5, wherein the optical compensation inspection circuit is configured to:

set a magnitude and a supply duration of each of the reference compensation voltages to compensate for a node voltage of each sub-pixel respectively at the start time and the end time of the image holding period; and transmitting a setting code or information corresponding to the set magnitude and supply duration associated with each of the start time and the end time to a data driver IC included in the data driver and a memory.

7. The device of claim 6, wherein the information corresponding to the set magnitude and supply duration associated with the start time includes:

a maximum compensation voltage value for compensating for an charging deviation at the start time;

a compensation voltage value associated with each step for a period for which the charging deviation at the start time is compensated for; and a time duration for which a reference compensation voltage associated with the start time is applied for each step.

8. The device of claim 6, wherein the information corresponding to the set magnitude and supply duration associated with the end time includes:

a maximum compensation voltage value for compensating for an charging deviation at the end time;

a compensation voltage value associated with each step for a period for which the charging deviation at the end time is compensated for; and a time duration for which a reference compensation voltage associated with the end time is applied for each step.

9. The device of claim 5, wherein the optical compensation inspection circuit includes:

an optical sensing circuit configured to measure and detect brightness and luminance characteristic variations of the image display panel on at least one frame basis using at least one photo sensor; and a reference compensation voltage setting circuit configured to set a magnitude and a supply duration of each of the reference compensation voltages to compensate for a node voltage of each sub-pixel respectively at the start time and the end time of the image holding period, based on the brightness and luminance characteristic variations measured and detected by the optical sensing circuit on a preset period or at least one frame basis.

10. The device of claim 9, wherein the reference compensation voltage setting circuit is further configured to:

set the magnitude and the supply duration of each of the reference compensation voltages to compensate for a node voltage of each sub-pixel respectively at the start time and the end time of the image holding period; and transmitting a setting code or information corresponding to the set magnitude and supply duration associated with each of the start time and the end time to each data driver IC included in the data driver and a memory.

11. The device of claim 1, wherein each sub-pixel includes an organic light-emitting diode, and a pixel circuit to control a light emission amount and a light-emitting timing of the organic light-emitting diode, wherein the pixel circuit has a source follower-based compensation circuit structure including first to fifth switching elements, a storage capacitor, and a driving switching element.

12. The device of claim 11, wherein for an initialization duration of the refresh period, the second switching element supplies an initialization voltage to the storage capacitor, the driving switching element, and the fourth switching element, and the fifth switching element supplies a high potential voltage to a first node connected to the third switching element, wherein for a compensation duration of the refresh period, the first switching element sequentially transmits the image data voltage to the driving switching element so that a threshold voltage based on the initialization voltage and the image data voltage is stored in the storage capacitor, and the third switching element and the fourth switching element allow the image data voltage compensated for based on the threshold voltage to be transmitted to the driving switching element, wherein for an image display duration of the refresh period, the driving switching element supplies a driving voltage of the organic light-emitting diode corresponding to a magnitude of the image data voltage for which the threshold voltage is compensated to the organic light-emitting diode.

13. A method for driving a display device including an image display panel, the method comprising:

receiving image data from an external data source;

aligning the image data based on a driving frequency characteristic of the image display panel;

supplying the aligned image data to a data driver to control a driving timing of the data driver;

controlling an output timing of a gate drive signal of a gate driver to drive a plurality of sub-pixels of the image display panel; and operating the data driver such that the plurality of sub-pixels are driven to display an image, wherein operating the data driver such that the plurality of sub-pixels are driven to display the image includes:

sequentially supplying an image data voltage corresponding to the image data to each of the sub-pixels for a refresh period set based on the driving frequency of the image display panel;

supplying different first and second preset reference compensation voltages to each of the sub-pixels respectively at a start time and an end time of an image holding period based on the driving frequency of the image display panel; and driving each data line to supply the first preset reference compensation voltage to each sub-pixel on at least one frame period basis at the start time of the image holding period such that the image data voltage is maintained to be either constant or substantially constant at the start time of the image holding period, wherein the first preset reference compensation voltage is associated with the start time of the image holding period.

14. The method of claim 13, wherein controlling the driving timing of each of the gate and data drivers includes:

dividing a plurality of frame periods into the refresh period and the image holding period based on the driving frequency of the image display panel;

generating a first gate control signal and a first data control signal so that each of the sub-pixels sequentially displays an image for the refresh period;

generating a second gate control signal and a second data control signal such that the image displayed on each of the sub-pixels is held on a frame basis for the image holding period;

supplying the first gate control signal and the first data control signal to the gate driver and the data driver respectively for the refresh period; and supplying the second gate control signal and the second data control signal to the gate driver and the data driver respectively for the image holding period.

15. The method of claim 13, wherein driving the plurality of sub-pixels of the image display panel to display the image includes:

in response to receiving a first gate control signal input from the timing controller for the refresh period, sequentially generating a plurality of first and second scan pulses and a plurality of first and second light-emitting control signals; and supplying the plurality of first and second scan pulses and the plurality of first and second light-emitting control signals to each of the sub-pixels; and in response to receiving a second gate control signal input from the timing controller for the image holding period, sequentially generating the plurality of first and second scan pulses and the plurality of first and second light-emitting control signals; and supplying the plurality of first and second scan pulses and the plurality of first and second light-emitting control signals to each of the sub-pixels either at the same timing as a timing of the refresh period or different timing from a timing of the refresh period.

16. The method of claim 13, wherein driving the plurality of sub-pixels of the image display panel to display the image further includes:

driving each data line to supply the second preset reference compensation voltage to each sub-pixel on at least one frame basis at the end time of the image holding period such that the image data voltage is maintained to be either constant or substantially constant at the end time of the image holding period, wherein the second preset reference compensation voltage is associated with the end time of the image holding period.

17. The method of claim 16, wherein supplying each of the first and second preset reference compensation voltage to each sub-pixel on at least one frame basis includes:

generating different first and second reference compensation voltages on at least one frame basis, based on values of reference compensation voltages set by an optical compensation inspection circuit respectively at the start time and the end time; and supplying the generated first and second reference compensation voltages to each of the sub-pixels respectively at the start time and the end time of the image holding period on at least one frame basis, wherein the values of the reference compensation voltages vary on at least one frame basis.

18. The method of claim 17, wherein the values of the reference compensation voltages are set based on at least one of brightness and luminance characteristic variations of the image display panel measured and detected by an optical sensing circuit in the optical compensation inspection circuit on a preset period or at least one frame basis.

19. The method of claim 13, wherein each sub-pixel includes an organic light-emitting diode, and a pixel circuit to control a light emission amount and a light-emitting timing of the organic light-emitting diode, wherein the pixel circuit has a source follower-based compensation circuit structure including first to fifth switching elements, a storage capacitor, and a driving switching element.

20. The method of claim 19, wherein driving the plurality of sub-pixels of the image display panel to display the image includes:

for an initialization duration of the refresh period, supplying, via the second switching element, an initialization voltage to the storage capacitor, the driving switching element, and the fourth switching element, and supplying, via the fifth switching element, a high potential voltage to a first node connected to the third switching element;

for a compensation duration of the refresh period, sequentially transmitting, via the first switching element, the image data voltage to the driving switching element so that a threshold voltage based on the initialization voltage and the image data voltage is stored in the storage capacitor, and transmitting, via the third switching element and the fourth switching element, the image data voltage compensated for based on the threshold voltage to the driving switching element; and for an image display duration of the refresh period, supplying, via the driving switching element, a driving voltage of the organic light-emitting diode corresponding to a magnitude of the image data voltage for which the threshold voltage is compensated to the organic light-emitting diode.

* * * * *